US006755565B2

(12) United States Patent
Flackett

(10) Patent No.: US 6,755,565 B2
(45) Date of Patent: Jun. 29, 2004

(54) DEEP HOLDER FOR DUAL ASYMMETRIC CENTRIFUGAL MIXING SYSTEM

(75) Inventor: Dale R. Flackett, Landrum, SC (US)

(73) Assignee: FlackTek, Inc., Landrum, SC (US)

( * ) Notice: Subject to any disclaimer, the term of this patent is extended or adjusted under 35 U.S.C. 154(b) by 0 days.

(21) Appl. No.: 10/417,683

(22) Filed: Apr. 17, 2003

(65) Prior Publication Data

US 2003/0198126 A1 Oct. 23, 2003

Related U.S. Application Data

(60) Provisional application No. 60/373,560, filed on Apr. 17, 2002.

(51) Int. Cl.[7] ..... B01F 9/22

(52) U.S. Cl. ..... 366/217

(58) Field of Search ..... 366/130, 204, 366/208–219; 494/31, 33; 206/564; 422/104; 220/506; 215/6

(56) References Cited

U.S. PATENT DOCUMENTS

| | | | | |
|---|---|---|---|---|
| 1,011,929 | A | * | 12/1911 | Ecaubert |
| 3,199,775 | A | * | 8/1965 | Drucker |
| 3,591,098 | A | * | 7/1971 | McShirley |
| 3,679,184 | A | * | 7/1972 | Woodham et al. |
| 3,778,033 | A | * | 12/1973 | Pullman |
| 4,235,553 | A | * | 11/1980 | Gall |
| 4,497,581 | A | * | 2/1985 | Miller |
| 4,728,197 | A | * | 3/1988 | Reinhard |
| 5,167,448 | A | * | 12/1992 | Herold et al. |
| 5,352,037 | A | * | 10/1994 | Jouvin |
| 5,547,275 | A | * | 8/1996 | Lillelund et al. |
| 5,551,779 | A | * | 9/1996 | Gantner et al. |
| 5,746,510 | A | * | 5/1998 | Mark et al. |
| 6,099,160 | A | * | 8/2000 | Flackett |

FOREIGN PATENT DOCUMENTS

| | | | |
|---|---|---|---|
| JP | 11-226376 | * | 8/1999 |
| JP | 2000-84388 | * | 3/2000 |
| JP | 2000-246082 | * | 9/2000 |
| JP | 2002-224551 | * | 8/2002 |
| JP | 2002-320835 | * | 11/2002 |
| JP | 2003-93862 | * | 4/2003 |

* cited by examiner

*Primary Examiner*—Charles E. Cooley
(74) *Attorney, Agent, or Firm*—Lisa A. Brzycki; Gehrke & Associates, S.C.

(57) ABSTRACT

A mixing system for mixing material includes a mixer having a housing, an arm in operable cooperation with the housing, wherein the arm is constructed and arranged to rotate about a first axis of rotation, and a basket constructed and arranged to rotate about a second axis of rotation in the opposite direction while the arm is rotating. A holder is removably received within the basket. A material container receives the material to be mixed, and the container is received within a lower half of the holder.

12 Claims, 3 Drawing Sheets

DEEP HOLDER FOR DUAL ASYMMETRIC CENTRIFUGAL MIXING SYSTEM

This application claims the benefit of U.S. provisional patent application No. 60/373,560 filed on Apr. 17, 2002, the entirety of which is herein incorporated by reference.

BACKGROUND OF THE INVENTION

1. Field of the Invention

The invention relates to a holder for use in a DAC centrifugal mixing system. More specifically, the invention relates to a DAC centrifugal mixing system having a modified holder configured to reduce the time needed to mix small materials.

2. Discussion of the Prior Art

In DAC centrifugal mixing systems, various weighted holders have been developed to allow mixing of different materials. In particular, the receptacle holding the material is placed within the top half of the holder. In other configurations, the receptacle is offset in the upper half of the weighted holder, thereby increasing the circumference of the mixing circle as the machine spins.

SUMMARY OF THE INVENTION

The present invention provides a mixing system for mixing viscous materials comprising a mixer, a material container and a holder.

According to a first aspect of the preferred embodiment of the present invention, a mixing system for mixing material includes a mixer having a housing, an arm in operable cooperation with the housing, wherein the arm is constructed and arranged to rotate about a first axis of rotation, and a basket constructed and arranged to rotate about a second axis of rotation in the opposite direction while the arm is rotating. A holder is removably received within the basket. A material container receives the material to be mixed, and the container is received within a lower half of the holder.

According to yet another aspect of the invention, a mixing system for mixing material includes a mixer having a housing, an arm in operable cooperation with the housing, wherein the arm is constructed and arranged to rotate about a first axis of rotation, and a basket constructed and arranged to rotate about a second axis of rotation in the opposite direction while the arm is rotating. A holder is removably received within the basket, and the holder includes a support wall forming a ridge. The material container includes a cap and a receptacle that receives the material to be mixed, and the receptacle includes a support surface. The cup is received substantially within the holder and the support surface abuts the ridge of the holder.

According to another aspect of the invention, a mixing apparatus for mixing material includes a mixer having a housing, an arm in operable cooperation with the housing, wherein the arm is constructed and arranged to rotate about a first axis of rotation, and a basket constructed and arranged to rotate about a second axis of rotation in the opposite direction while the arm is rotating. A holder is removably received within the basket. A material container includes a cap and a receptacle that receives the material to be mixed.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

The present invention and various features and advantageous details thereof are explained more fully with reference to the non-limiting embodiments that are illustrated in the accompanying drawings and detailed in the following description. Descriptions of well-known components and processes are omitted so as to not necessarily obscure the present invention in detail.

The present invention is a system for mixing pasty material, such as sealant. The system includes a material container that allows the material to be mixed in a more efficient manner when compared to conventional mixing systems.

Figure 1:
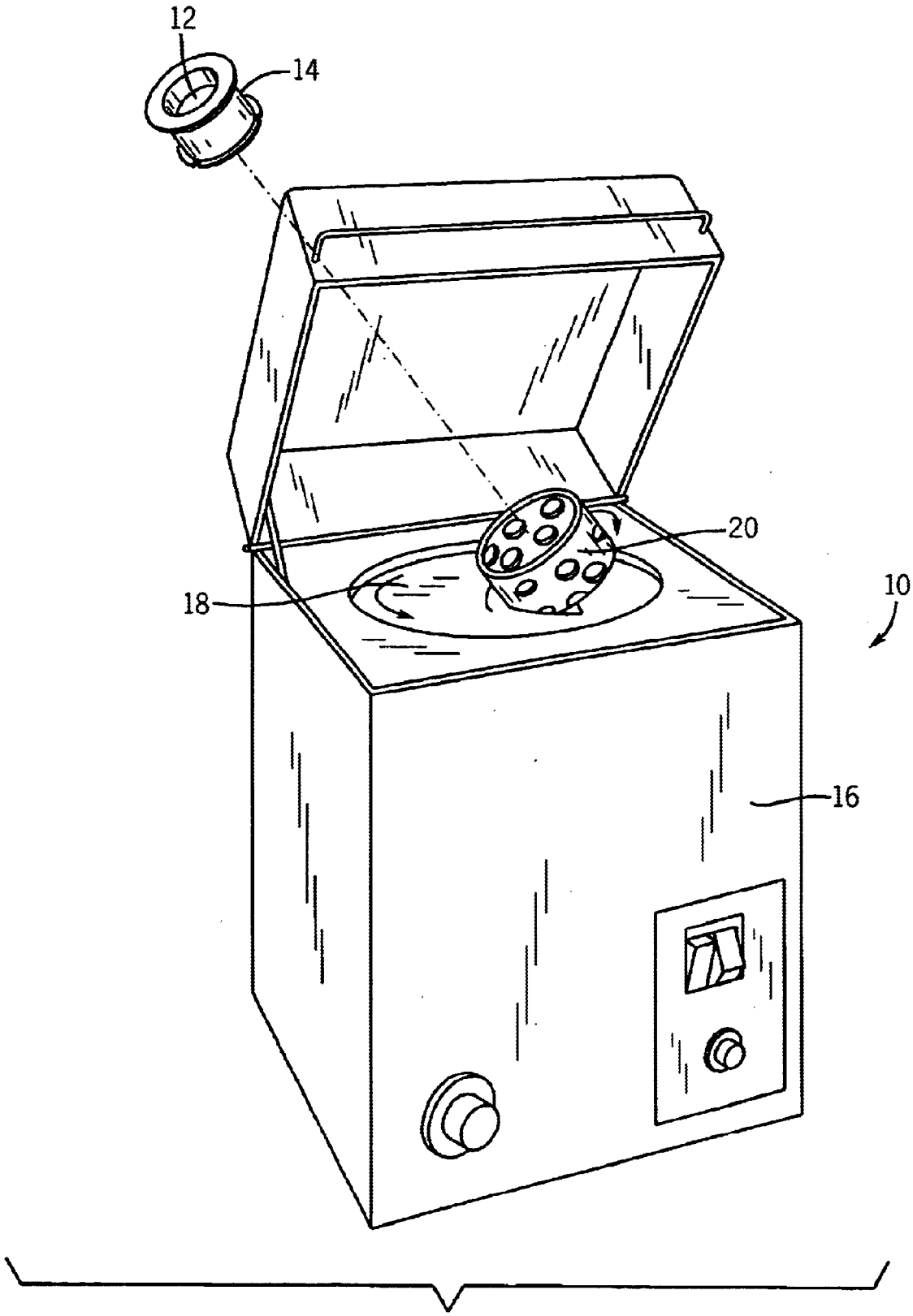
FIG. 1 is an exploded view of a mixer and a material container according to the present invention.

Referring now to the drawings, FIG. 1 of the present invention illustrates an exploded view of a mixer 10, a material container 12, and a holder 14 of the mixing system.

Mixer 10 comprises a dual asymmetric centrifuge having a housing 16, an arm 18 mounted in operable cooperation with housing 16, and a basket 20 carried by arm 18. Basket 20 moves in the opposite direction of arm 18. Basket 20 is shaped and designed to receive holder 14 with material container 12. Arm 18 is constructed and arranged to rotate about a first axis of rotation while basket 20 is constructed to rotate about a second axis of rotation in a direction opposite the first axis of rotation, when mixer 10 is in use.

Holder 14 is shaped to receive material container 12 that is placed deep within holder 14. Holder 14 with material container 12 is placed into basket 20 to stabilize material container 12 during rotation of basket 20.

Figure 2:
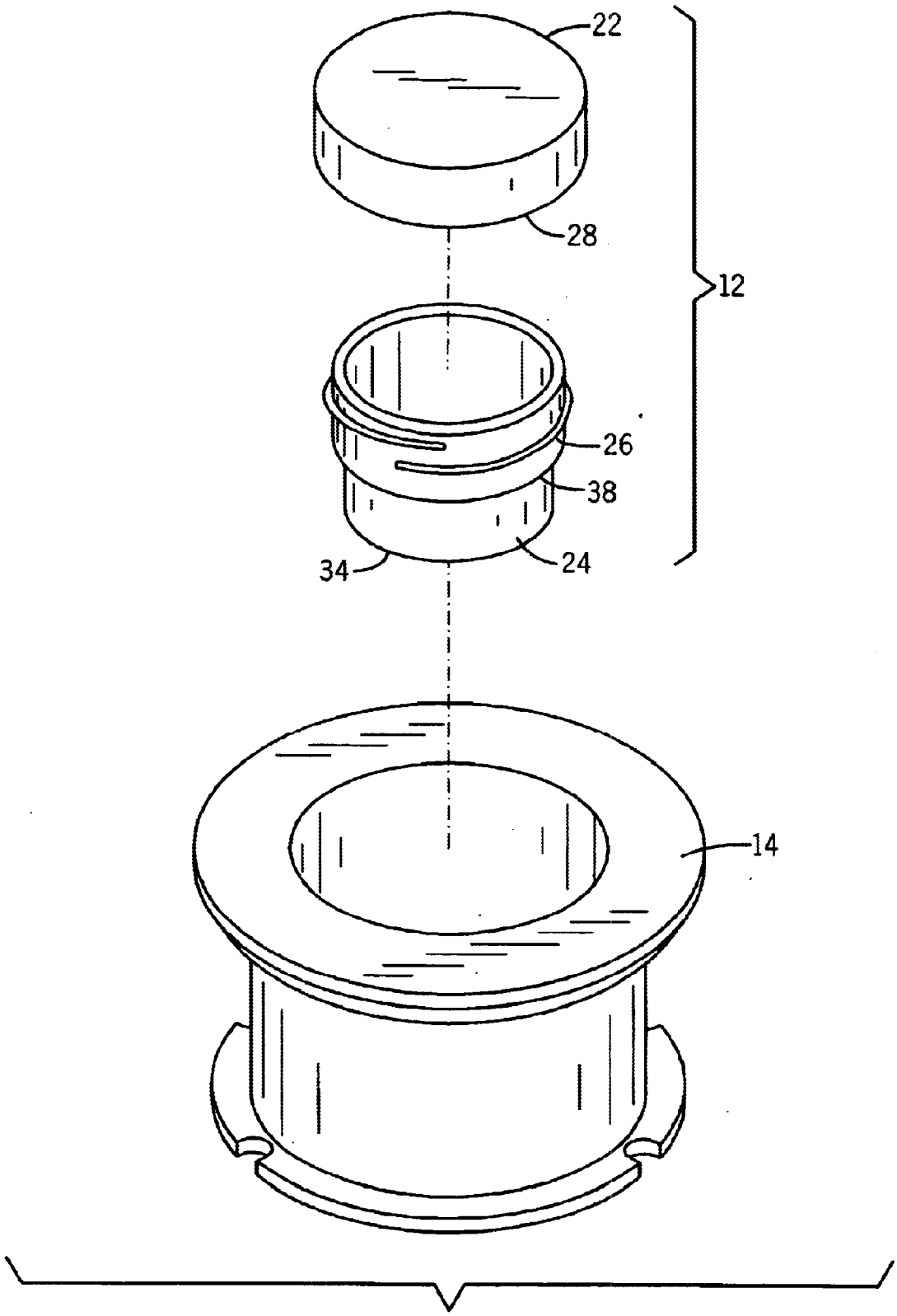
FIG. 2 is an exploded view of a material container and a holder according to the present invention.

Referring to FIG. 2, material container 12 includes a cap 22 and a receptacle 24 for mixing material. Receptacle 24 includes a first threaded portion 26 that mates with a second threaded portion 28 formed on cap 22. Receptacle 24 may be formed of a rigid flexible material. The diameter of the receptacle 24 may range from 2.54–10.16 cm, and most preferably from 4.8–9.0 cm. The length of the receptacle 24 may range from 2.54–20.0 cm, and most preferably from 3.8–10.16 cm.

Figure 3:
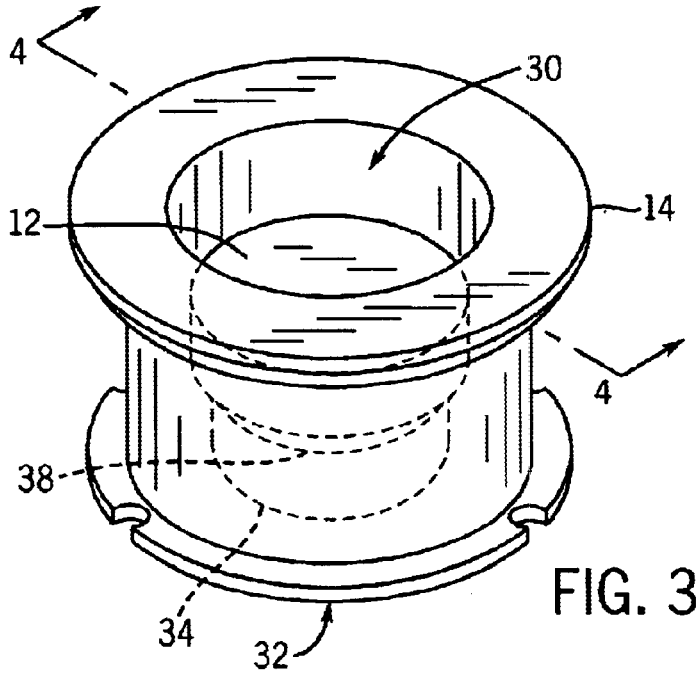
FIG. 3 is a perspective view of the material container and holder according to the present invention.
Figure 4:
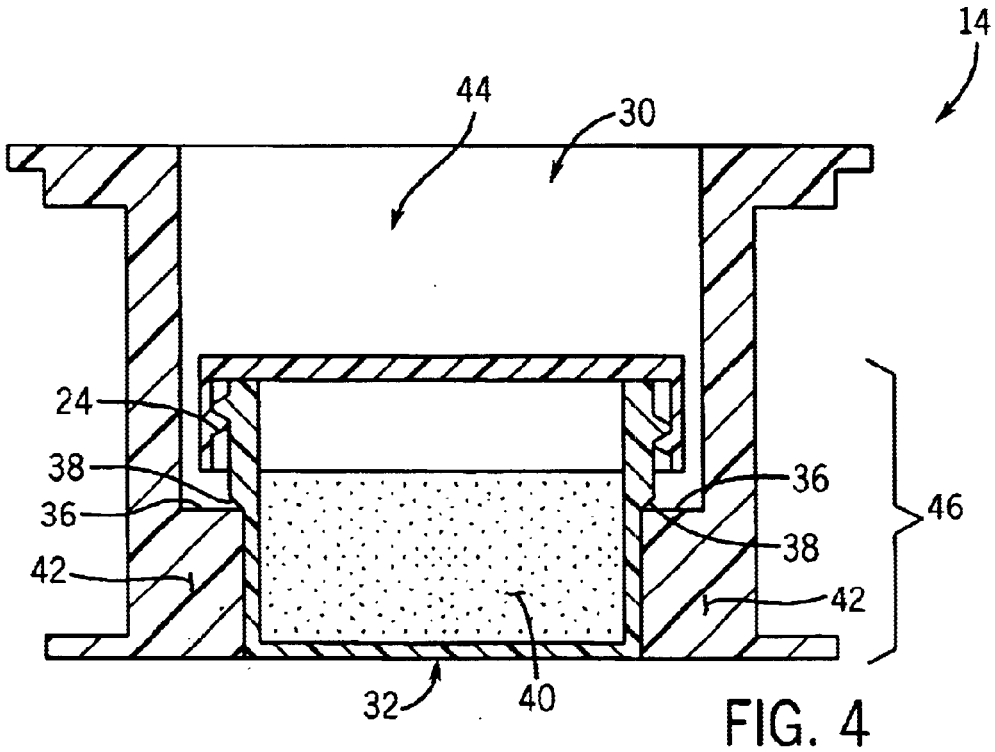
FIG. 4 is a cross-sectional view of the material container and holder along line 4—4 of FIG. 3 according to the present invention.

Referring now to FIGS. 3 and 4, holder 14 has a first opening 30 for receiving material container 12 and a second opening 32. In the preferred embodiment of the present invention, the bottom 34 of material container 12 is flush with second opening 32 of holder 14. The diameter of second opening 32 is generally smaller than the diameter of first opening 30 to form a ridge 36. Ridge 36 abuts a support surface 38 formed integral with and around the outside surface of receptacle 24 below first threaded portion 26.

In operation, material 40 is filled into receptacle 24 and first threaded portion 26 of cap 22 is screwed together with second threaded portion 28 (FIG. 2). Material holder 12 is placed into holder 14 so that ridge 36 of holder 14 engages support surface 38 of receptacle 24, and a support wall 42 frictionally engages the circumference of a portion of receptacle 24.

Receptacle 24 is centrally received deep within a cavity 44 in holder 14. In this regard, receptacle 24 is frictionally held within a lower half 46 of holder 14. The depth of receptacle 24 within cavity 44 of holder 14 reduces mixing times and increases the efficiency of mixer 10.

In particular, receptacle 24 seated within lower half 46 of holder 14 makes a larger rotational circle within mixer 10 as compared to holder 14 traversing a smaller circle if it is placed on top of holder 14. Therefore, in the preferred embodiment of the present invention wherein receptacle 24 is placed within cavity 44, the mixing time (at a constant speed) is reduced over the prior art. Similarly, the mixing speed (at a constant time) of the present invention is reduced over the prior art.

A comparison of the preferred embodiment of the present invention as compared to the mixing apparatus disclosed in U.S. Pat. No. 6,099,160 includes mixing a certain amount of paste with a certain amount of color to test the mixing variables of the embodiment of receptacle 24 within cavity 44 disclosed herein as compared to the mixing cup on top of the holder (U.S. Pat. No. 6,099,160).

| MAX ™ 10 g CUP | | |
|---|---|---|
| Test using 5 g of paste and 0.05 g of color paste: | | |
| 1. | Apparatus of 6,099,160: | 5 minutes at 3,500 rpm |
| 2. | Receptacle 24 within cavity 44: | 3 minutes at 3,000 rpm |
| MAX ™ 15 g CUP | | |
| Test using 10 g of paste and 0.1 g of color paste: | | |
| 1. | Apparatus of 6,099,160: | 4 minutes at 3,500 rpm |
| 2. | Receptacle 24 within cavity 44: | 2 minutes at 3,000 rpm |

As illustrated above, the location of receptacle 24 within lower half 46 of holder 14 significantly increases the efficiency of mixer 10.

The scope of the application is not to be limited by the description of the preferred embodiments described above, but is to be limited solely by the scope of the claims that follow.

What is claimed is:

1. A mixing system for mixing material comprising:

a mixer having a housing, an arm in operable cooperation with the housing, wherein the arm is constructed and arranged to rotate about a first axis of rotation, and a basket constructed and arranged to rotate about a second axis of rotation in the opposite direction while the arm is rotating;

a holder removably received within the basket; and a material container that receives the material to be mixed, wherein the container is received within a lower half of the holder.

2. The mixing system of claim 1 wherein the container includes a cap having a first threaded surface that engages a second threaded surface formed on the container.

3. The mixing system of claim 1 wherein the mixer comprises a dual asymmetric centrifuge.

4. The mixing system of claim 1, wherein the material container is formed of a rigid material.

5. The mixing system of claim 1, wherein the material container is formed of a flexible material.

6. The mixing system of claim 1, wherein the material comprises a sealant or a pasty material when mixed.

7. The mixing system of claim 1, wherein the material container includes a syringe.

8. The mixing system of claim 1, wherein the material container includes a cartridge.

9. A mixing system for mixing material comprising:

a mixer having a housing an arm in operable cooperation with the housing, wherein the arm is constructed and arranged to rotate about a first axis of rotation, and a basket constructed and arranged to rotate about a second axis of rotation in the opposite direction while the arm is rotating;

a holder removably received within the basket, wherein the holder includes a support wall forming a ridge and wherein the holder includes a first opening opposite a second opening; and a material container including a cap and a receptacle that receives the material to be mixed, wherein the receptacle includes a support surface and the receptacle is received substantially within the holder and the support surface abuts the ridge of the holder.

10. The mixing system of claim 9, wherein the material container is received generally within a lower half of the holder.

11. The mixing system of claim 9, wherein the cap includes a first threaded surface that engages a second threaded surface formed on the receptacle adjacent the support surface.

12. A mixing system for mixing material comprising:

a mixer having a housing, an arm in operable cooperation with the housing, wherein the arm is constructed and arranged to rotate about a first axis of rotation, and a basket constructed and arranged to rotate about a second axis of rotation in the opposite direction while the arm is rotating;

a holder removably received within the basket; and a material container including a cap and a receptacle that receives the material to be mixed, wherein the material container is generally received within a lower half of the holder.

* * * * *